US006409645B1

(12) United States Patent
Paasonen et al.

(10) Patent No.: US 6,409,645 B1
(45) **Date of Patent: *Jun. 25, 2002**

(54) ROLL COVER

(75) Inventors: Jan A. Paasonen, Kerava; Seppo A. Yliselä, Järvenpää , both of (FI)

(73) Assignee: SW Paper Inc., Southborough, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/874,757

(22) Filed: Jun. 13, 1997

(51) Int. Cl.[7] ..... F16C 13/00
(52) U.S. Cl. ..... 492/56; 492/48; 101/375
(58) Field of Search ..... 492/56, 48, 52, 492/53, 45; 118/70, 259, 60; 428/372, 34.1; 219/216, 505; 165/135; 101/376, 216, 217, 375, 401.1, 153

(56) References Cited

U.S. PATENT DOCUMENTS

| | | | | | |
|---|---|---|---|---|---|
| 1,384,806 | A | * | 7/1921 | Reed | 492/45 |
| 1,993,718 | A | * | 3/1935 | Miner | 118/259 |
| 2,597,858 | A | * | 5/1952 | Freedlander | 492/52 |
| 3,184,828 | A | | 5/1965 | Dames, Jr. | |
| 3,646,652 | A | | 3/1972 | Heiligenthal et al. | |
| 3,800,381 | A | | 4/1974 | Brafford | |
| 3,877,919 | A | * | 4/1975 | Shorr | 65/194 |
| 4,064,313 | A | * | 12/1977 | Takiguchi et al. | 492/56 |
| 4,178,664 | A | * | 12/1979 | McLoughlin | 492/48 |
| 4,258,089 | A | | 3/1981 | Anderson et al. | |
| 4,288,058 | A | | 9/1981 | Inman | |
| 4,309,803 | A | | 1/1982 | Blaszak | |
| 4,368,568 | A | | 1/1983 | Watanabe | |
| 4,551,894 | A | | 11/1985 | Beucker | |
| 4,576,845 | A | | 3/1986 | Krotchko | |
| 4,705,711 | A | | 11/1987 | Perna | |
| 4,760,232 | A | | 7/1988 | Smith | |
| 4,829,931 | A | * | 5/1989 | Mogi | 118/70 |
| 4,842,944 | A | | 6/1989 | Kuge et al. | |
| 4,887,340 | A | * | 12/1989 | Kato et al. | 492/56 |
| 4,903,597 | A | * | 2/1990 | Hoage et al. | 101/401.1 |
| 4,998,333 | A | | 3/1991 | Skyttä | |

(List continued on next page.)

FOREIGN PATENT DOCUMENTS

| | | | | |
|---|---|---|---|---|
| DE | 4007141 | * | 4/1991 | 492/56 |
| JP | 61-171913 | * | 8/1986 | 492/56 |
| JP | 61-258794 | * | 11/1986 | 492/56 |
| JP | 2-259186 | * | 10/1990 | 492/56 |
| JP | 5-106189 | * | 4/1993 | 492/56 |
| JP | 6-58324 | * | 3/1994 | 492/56 |
| WO | WO 94/09208 | | 4/1994 | |
| WO | WO 95/17298 | | 6/1995 | |
| WO | WO 96/31342 | | 10/1996 | |
| WO | WO 97/38162 | | 10/1997 | |

OTHER PUBLICATIONS

Watanabe; *Method for Producing a Hardened Roller*, Japan Patent Office, Patent Announcement Hei 3–47359, Application SHO 62–335378, Date of Application: Dec. 30, 1987, Disclosure Announcement Hei 1–260092 Oct. 17, 1989.

Paasonen; *The Role of Composite Roll Covers in Soft and Super Calendering*, 46$^{th}$ Congress Annual ATIP, Grenoble, Oct. 20–22, 1993, pp. 1–13.

*Primary Examiner*—I Cuda Rosenbaum
*Assistant Examiner*—T. Nguyen
(74) *Attorney, Agent, or Firm*—Myers Bigel Sibley & Sajovec

(57) ABSTRACT

A covered roll structure employed in the manufacture of a paper machine roll comprises a core roll having a substantially cylindrical outer surface, a sleeve of removable material surrounding the core roll outer surface, a sleeve of compressible material surrounding the sleeve of removable material, and a sleeve of polymeric material surrounding the sleeve of compressible material and the sleeve of removable material.

16 Claims, 2 Drawing Sheets

U.S. PATENT DOCUMENTS 5,014,406 A * 5/1991 Kato et al. ..... 492/52
5,023,985 A 6/1991 Salo et al.
5,091,027 A 2/1992 Watanabe
5,138,766 A 8/1992 Kimura et al.
5,167,068 A 12/1992 Leino et al.
5,217,532 A * 6/1993 Sasame et al. ..... 118/60
5,235,747 A 8/1993 Leino et al.
5,253,027 A * 10/1993 Goto ..... 492/56
5,294,909 A * 3/1994 Frazier ..... 219/505
5,376,448 A * 12/1994 Suzuki et al. ..... 428/372
5,403,995 A * 4/1995 Kishino et al. ..... 219/216
5,412,870 A 5/1995 Lehtonen
5,415,612 A * 5/1995 Calrson et al. ..... 492/56
5,435,054 A * 7/1995 Tonder et al. ..... 29/623.5
5,505,492 A * 4/1996 Nelson et al. ..... 428/34.1
5,520,600 A * 5/1996 Fukumoto ..... 492/56
5,553,381 A * 9/1996 Lehtonen ..... 492/53
5,555,932 A * 9/1996 Dudley ..... 165/135
5,601,920 A 2/1997 Paasonen et al.
5,709,765 A * 1/1998 Herbert et al. ..... 156/293
5,742,880 A * 4/1998 Takenaka et al. ..... 492/56
5,761,801 A * 6/1998 Gebhardt et al. ..... 29/846
5,763,068 A * 6/1998 Kishino et al. ..... 492/56
5,780,131 A 7/1998 Paasonen et al.
5,797,322 A * 8/1998 Lorig et al. ..... 492/56
5,857,950 A * 1/1999 Hycner ..... 492/53
5,860,360 A * 1/1999 Lane, III et al. ..... 492/56

* cited by examiner

ROLL COVER

FIELD OF THE INVENTION

The present invention relates to covered rolls used in papermaking operations and methods of producing the same. More specifically, the invention relates to covered rolls used in papermaking operations which contain a polymeric coating material which is more easily removed from the roll upon which it is processed.

BACKGROUND OF THE INVENTION

Cylindrical rolls are utilized in a number of industrial applications, especially those relating to papermaking. Such rolls are typically employed in demanding environments in which they can be exposed to high dynamic loads and temperatures. As an example, in a typical paper mill, rolls are used not only for transporting a fibrous web sheet between processing stations, but also, in the case of pressure and calendar rolls, for processing the web sheet itself into paper.

Pressure rolls are included, inter alia, in the press section of a papermaking machine in which press felts apply pressure to a newly formed web and, through heat and pressure, remove moisture from the web. Typically, the web is conveyed on the press felt through a nip between two pressure rolls, which tends to squeeze moisture from the web. In this environment, such pressure rolls are subjected to high dynamic loads due to the extreme pressures and high paper speeds, and also to moisture. Accordingly, the rolls should be strong, tough, wear-resistant, and moisture-resistant. Also, often the rolls are "crowned" along the longitudinal axis for to reduce wrinkling of the web.

Calender rolls are often employed in the calendering section of a papermaking machine. Typically, a series of calender rolls are positioned to define a somewhat convoluted path for the paper web, with some of the rolls located closely enough to one another that they apply pressure to the paper web. Calendering is performed primarily to improve the smoothness and gloss of the paper, each of which are affected by the number and surface hardness of the calender rolls and pressure applied thereby.

Because papermaking rolls can have many different performance demands, and because replacing an entire metallic roll can be quite expensive, many papermaking rolls include a polymeric cover that surrounds the circumferential surface of a metallic core. By varying the polymer employed as a cover, the designer can provide the roll with different performance characteristics as the papermaking application demands. Also, replacement of a cover over a metallic roll can be less expensive than the replacement of an entire metallic roll. The polymers used in the cover are most often thermosets or thermoplastics.

In addition, some rolls comprise a polymeric shell core. In these rolls, the shell is typically supported by an internal frame which includes hydraulic or pneumatic cylinders that press on the inner surface of the shell. In manufacturing the cover shell for a roll, generally a polymer is applied to a core formed of metal or some other rigid material, cast or molded into the desired shape, and cured. The cover or shell is then removed from the mold core and bonded to a core or internal frame.

Problems arise in the creation of polymer covers or shells due to the marked difference in thermal expansion between the polymeric material and the material of the core. More specifically, the polymeric material typically has a coefficient of thermal expansion which is an order of magnitude greater than that of the metal. As a result, the sleeve formed from the polymeric material tends to shrink, and thus closely clings or sticks to the mold core. Accordingly, it is often very difficult to remove the polymeric sleeve from the mold core. Additionally, due to the shrinkage of the polymeric material, undesirable residual stresses may form therein.

There remains a need in the art to provide polymeric covers and shells which are more easily removable from the core molds upon which they are made.

SUMMARY OF THE INVENTION

In view of the foregoing, it is an object of the present invention to provide a covered roll structure for use in papermaking which allows a sleeve of polymeric material formed thereon to be more easily removed from the roll structure.

It is another object of the present invention to provide a method of producing such a covered roll structure.

To this end and others, the present invention provides covered roll structures which allow the sleeve of polymeric material formed thereon to be more easily removed from roll structures than conventional polymeric sleeves. Once removed, the sleeve of polymeric material can be used to cover another core to form a roller or used as a shell by itself or with an internal frame.

In one embodiment, a roll structure is formed by first applying a removable material, preferably formed from an inorganic pre-impregnated powder, to a mold core having a cylindrical outer surface to form a sleeve of removable material. The removable material preferably has a melting point of at least about 100° F. Subsequently, polymeric material is applied over the sleeve of removable material to form a sleeve of polymeric material. The sleeve of polymeric material is subsequently cured, and the removable material is dissolved or otherwise removed from the roll structure. As a result, the sleeve of polymeric material, which can serve as either a cover or a shell, can be readily removed from the roll structure.

In another embodiment, a sleeve of compressible material may be formed subsequent to the formation of the sleeve of removable material and prior to the formation of the sleeve of polymeric material. Advantageously, the compressible material is able to contract during and after the curing process such that the polymeric material may be able to shrink to a greater extent than if removable material were present without the compressible material. This structure can reduce the amount of stress present in the cover or shell. If desired, the sleeve of polymeric material may be readily removed from the roll structure and attached to a roll core or frame. Alternatively, the sleeve can be bonded to the mold core, which also serves as the core for the operational roll itself. The compressible material can also serve as a conduit for solvent if the removable material is to be removed by dissolution with that solvent.

DETAILED DESCRIPTION OF THE INVENTION

Figure 1:
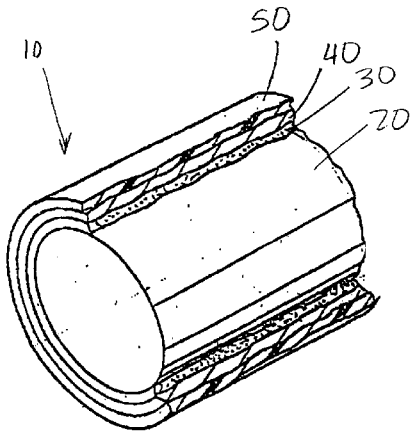
FIG. 1 is a perspective view of a covered roll structure employed in the manufacture of a paper machine roll.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

Referring now to the drawings, FIG. 1 illustrates a covered roll structure 10 of the present invention, which includes a core roll (i.e., a mold core) 20, a sleeve 30 of removable material, a sleeve 40 of compressible material, and a polymeric sleeve 50. The roll structure 10 may be used in forming the sleeve 50 of polymeric material (described in greater detail herein) which may eventually removed from the remainder of the roll structure 10. The polymeric sleeve 50 may be then be used alone as a shell structure, in combination with an internal core, or in combination with an internal support framework. The polymeric sleeve 50 may also be bonded over a roll structure different from the one it is made on, or may remain with and become attached to the core roll 20. In either instance, such roll structures may be used in a variety of applications in papermaking operations such as calendaring rolls, suction rolls, wireturning rolls, or a press rolls.

As illustrated, the core roll 20 has a substantially cylindrical outer surface. The core roll 20 may be fabricated from a number of various materials, such as cast iron, rolled and welded pipe, cast steel (e.g., POLYCAST™), ductile iron, chilled iron, stainless steel and alloys thereof, and bronze. Alloys of the above may also be used. In addition, a base coat of fiberglass or epoxy is commonly included. If the polymer sleeve 50 is to remain attached to the core roll 20, it is preferred that the core roll 20 be formed of cast iron, chilled iron, ductile iron or stainless steel.

The size of the core roll 20 can vary greatly, depending on the desired size of the polymer sleeve 50. For example, the core roll can have a diameter ranging from about 2 to about 60 inches, and a length ranging from about 5 to about 30 feet.

Referring still to FIG. 1, a sleeve 30 of removable material surrounds the outer surface of the core roll 20. As used herein, "removable material" refers to material that is added to the core roll 20 or other underlying support substrate which may be displaced from the core roll 20 to leave a void space in the volume formerly occupied without first removing the overlying polymeric sleeve 50. As a result, the polymeric sleeve 50 may be more easily removed from the core roll 20.

The removable material preferably comprises a heat resistant inorganic pre-impregnated powder, such as a ceramic or metallic powder, and more preferably comprises such a powder that can be dissolved with an aqueous solvent. For the purposes of the invention, the term "aqueous solvent" is to be broadly construed to include water in the form of, for example, tap water, distilled water, and mixtures thereof. The aqueous solvent may also include a number of appropriate additives such as, for example, buffering agents. The heat resistant inorganic pre-impregnated powder typically includes an inorganic core binder, an inorganic filler, water, and surface active agents. In particular, the removable material preferably includes one or more low melting eutectic salts or alloy.

Alternatively, the removable material can comprise an organic material, such as polyacrylate, polyacrylamide, starch, or polyvinyl alcohol, each of which are water-soluble polymers. These can be used unfilled or filled with a particulate filler, such as sand, which the polymer bonds in a desired configuration. The addition of water causes the polymer to dissolve.

Preferably, the removable material has a melting temperature ranging from at least about 70° F. to about 500° F. or higher, and more preferably from about 100° F. to about 450° F. It is desirable that the removable material be able to withstand these temperatures without melting or otherwise breaking down in order to remain in place as molten polymeric material is applied.

Also, it is preferred that the removable material have a relatively low thermal expansion rate. This enables the removable material to maintain its circumferential stability at polymer processing temperatures.

The sleeve 30 of removable material may be employed in various thicknesses, preferably from about 1/16 to about 1 inch. Preferably, the ratio of the thickness of the circumference of the core roll 20 to the sleeve 30 of removable material ranges from about 0.02 to about 1.

Those skilled in the art will recognize that a number of techniques may be used to apply removable material to core roll 20. For example, a trowel may be used to spread removable material onto the core roll 20. Alternatively, the removable material may be extruded onto the core roll 20.

As shown in FIG. 1, the sleeve 40 of compressible material surrounds the sleeve 30 of removable material. The term "compressible material" refers to material which compresses when polymeric material shrinks during cooling. As a result, residual stress formation may be minimized in the polymeric sleeve 50.

The compressible material may be formed from a number of components, including various thermoplastic and thermoset materials such as, for example, polyester, polyamide, para-amide, polyurethane or butadiene. Additional filler materials, such as mineral or metal material, may also be included in sleeve 40. The compressible material preferably has a modulus of elasticity ranging from about 145 psi to about 14,500 psi, and more preferably from about 145 psi to about 4,000 psi. The sleeve of compressible material 40 has a preferred thickness ranging from about 1/16 to about 1 inches such that the ratio of its thickness to the circumference of the core roll ranges from about 0.02 to about 1. In some embodiments, it is preferred that the compressible material be sufficiently porous to allow solvent to pass therethrough and dissolve the sleeve 30 of removable material.

Referring still to FIG. 1, the sleeve 50 of polymeric material surrounds the sleeve 40 of compressible material. A number of polymers may be used in sleeve 50, including, for example, thermoplastic and thermosetting polymers such as polypropylene, polyether sulfone, polyetheretherketone, epoxy, polyurethane, polyimide, and cyanate resins, and copolymers, mixtures and blends thereof. The sleeve 50 of polymeric material preferably has a modulus of elasticity ranging from about 200,000 psi to about $30\times10^6$ psi, and a preferred thickness ranging from about 1/8 to about 1 inches. The ratio of the sleeve 50 of polymeric material to the circumference of the core roll 20 preferably ranges from about 0.03 to about 1. The polymers may contain particulate fillers and/or fibers, such as glass, talc or other minerals, or the like.

Figure 2A:
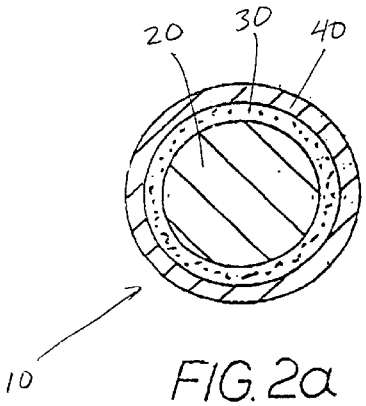
FIGS. 2*a*–2*c* are cross-sectional views of a method of forming a roll for a papermaking machine which includes employing a sleeve of removable material and a sleeve of compressible material.
Figure 2B:
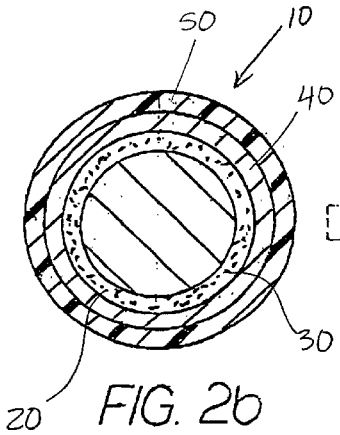
Figure 2C:
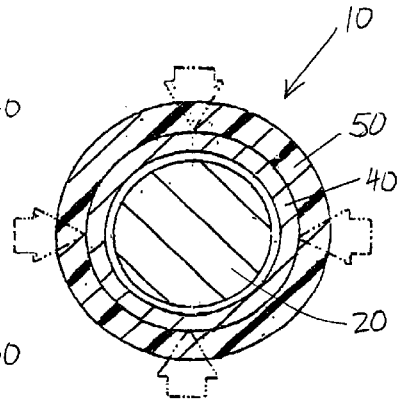

FIGS. 2*a*–2*c* schematically illustrate a method for forming a roll structure 10 for a papermaking machine in accordance with the present invention. As shown in FIG. 2*a,* removable material is first applied to core troweling, extruding, overlaying, or the like) the removable material onto the cylindrical surface of the core roll 20. If desired, the sleeve 30 of removable material may be further treated by an appropriate technique, such as with a mold release compound.

After the removable material is applied to the core structure, compressible material is applied to the core roll 20 to form the sleeve 40 (FIG. 2*a*). The compressible material is typically applied to the core roll 20 by a trowel or extrusion technique. Subsequently, molten polymeric material is applied over the compressible material to form sleeve 50 and thus a covered roll structure (FIG. 2*b*). The polymeric material may be applied utilizing any appropriate techniques which are known to the skilled artisan. For example, the sleeve 50 of polymeric material may be formed by extrusion, static casting, centrifugal casting, molding, winding and the like. The polymeric material is applied until a pre-selected thickness (preferably between about ⅛ and 1 inches) is obtained.

Subsequently, the sleeve 50 of polymeric material is cured. Typically, if the sleeve 50 is made of thermoset polymer this step is carried out by inserting the roll structure 10 in a oven or like apparatus which exposes the polymeric material to sufficient temperature and time conditions such that the polymeric material becomes cured. Hardening can be carried out for other materials, such as thermoplastics, by simply allowing the polymeric material in molten form to cool. Preferably, heating is carried out at a temperature ranging from about 50° C. to about 300° C., and more preferably from about 100° C. to about 200° C. Curing preferably lasts in duration from about 1 to about 60 hours, and more preferably from about 10 to about 40 hours, for thermoset materials. The curing step can also be employed under various pressure conditions, including a vacuum. Variations of the above processing conditions may be utilized as known by the skilled artisan according to differences in the types of materials used in sleeves 30, 40, and 50.

Subsequent to or concurrent with curing, the sleeve 50 is allowed to cool at a predetermined rate, preferably between about 0.1° C./h. and about 3° C./h. As the polymeric material sleeve 50 cools, it shrinks at a rate that is particular to the polymeric material. This rate is typically much greater than the shrinkage for the underlying core 20 and sleeves 30 and 40. As a result, the polymer sleeve 50 constricts onto the compressible sleeve 40 (indicated by arrows in FIG. 2*c*).

Next, as illustrated in FIG. 2*c,* the sleeve 30 of removable material is removed from the roll 20. The sleeve 30 is preferably removed from the roll 20 by contacting the removable material with a solvent, preferably an aqueous solvent, which allows the removable material to be dissolved therein. The aqueous solvent is preferably applied to the polymeric material at a temperature ranging from about 5° C. to about 100° C. The removable material dissolved in the solvent may then be transported to an appropriate system which allows for the removable material to be separated from the aqueous solvent. As a result, the removable material may be reused.

As illustrated in FIG. 2*c,* the void space created by the shrinkage of the compressible material and by the absence of the sleeve 30 of removable material allows the sleeve 50 of polymeric material to shrink in a radially inward direction (denoted by arrows). After cooling is completed, the sleeve 50 of polymeric material may be removed therefrom and placed on another core structure for use in papermaking. Alternatively, the sleeve 50 may be removed from the roll 20 and supported internally to serve as a controlled crown roll. Also, the sleeve 50 may remain on core roll 20 and adhered thereto.

Figure 3A:
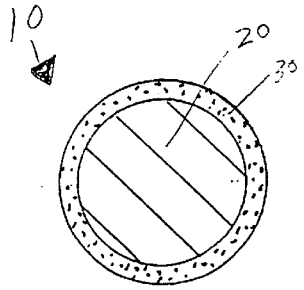
FIGS. 3*a*–3*c* are cross-sectional views of a method of forming a roll for a papermaking machine which includes employing a sleeve of removable material.
Figure 3B:
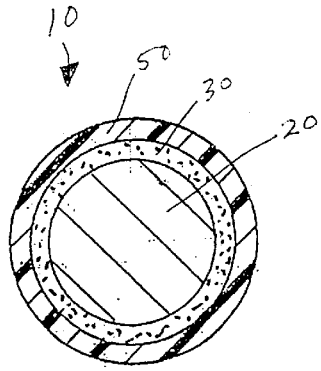
Figure 3C:
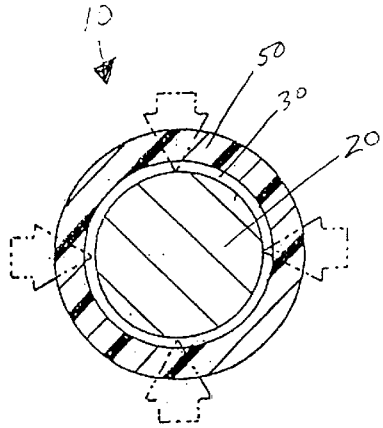

FIGS. 3*a*–3*c* represent another method of forming a roll structure for a papermaking machine in accordance with the invention. In this embodiment, removable material is applied to core roll 20 in a manner described above to form sleeve 30 (FIG. 3*a*). After this step, polymeric material is applied over the sleeve 30 of removable material to form a sleeve 50 (FIG. 3*b*). The polymeric material 50 is then cured using techniques as set forth herein.

Subsequent to the curing step, the roll structure 10 is transported from the mold, and the sleeve 30 of removable material is removed from the roll 20 by using the techniques described herein (FIG. 3*c*). Despite shrinkage during cure, the sleeve 50 of polymeric material may be readily removed from the core roll 20 if so desired.

Figure 4A:
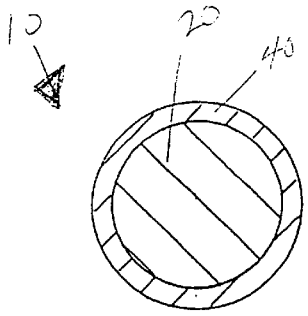
FIGS. 4*a*–4*c* are cross-sectional views of a method of forming a roll for a papermaking machine which includes employing a sleeve of compressible material.
Figure 4B:
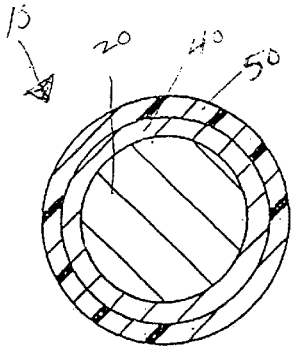
Figure 4C:
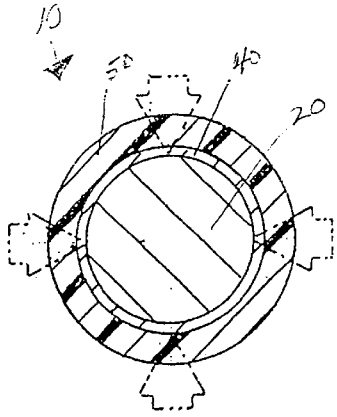

FIGS. 4*a*–4*c* illustrate another method of forming a roll structure 10 for a papermaking machine in accordance with the present invention. As shown in FIG. 4*a,* compressible material is first applied to core roll 20 to form sleeve 40 by employing the techniques described herein. After the compressible material is applied to the core structure, polymeric material is applied over the compressible material to form sleeve 50 and thus a covered roll structure (FIG. 4*b*). The polymeric material is applied by using the techniques set forth above.

The curing of the polymeric material is carried out in similar fashion to that described herein. As shown in FIG. 4*c* and elsewhere, the sleeve 50 of polymeric material contracts radially inward (see arrows). During curing, the compressible material advantageously absorbs stresses such that minimal residual stresses are formed in sleeve 50. Subsequent to curing, the sleeve 50 may be adhered to the core roll 20 by using, for example, an epoxy, or may be removed from the core roll 20.

In the specification and drawings, there have been disclosed typical preferred embodiments of the invention and, although specific terms are employed, they are used in a generic and descriptive sense only and not for purposes of limitation of the scope of the invention being set forth in the following claims.

That which is claimed is:

1. A covered roll structure employed in the manufacture of a paper machine roll, said structure comprising:

a core roll having a substantially cylindrical outer surface;

a sleeve of removable material surrounding said core roll outer surface;

a sleeve of compressible material surrounding said sleeve of removable material; and a sleeve of polymeric material surrounding said sleeve of compressible material and said sleeve of removable material.

2. The covered roll structure according to claim 1, wherein the removable material comprises an inorganic material.

3. The covered roll structure according to claim 1, wherein the removable material has a melting point ranging from about at least 70° F. to about 500° F.

4. The covered roll structure according to claim 1, wherein the polymeric material is selected from the group consisting of polypropylene, polyethersulfone, polyetherketone, epoxy, polyimide, and polyurethane.

5. The covered roll structure according to claim 4, wherein said polymeric material includes fiber or particulate fillers.

6. The covered roll structure according to claim 1, wherein the polymeric material has a modulus of elasticity ranging from about $20\times10^4$ psi to about $30\times10^6$ psi.

7. The covered roll structure according to claim 1, wherein the compressible material is selected from the group consisting of polyester, polyamide, para-amide, polyurethane and butadiene.

8. The covered roll structure according to claim 1, wherein the compressible material has a modulus of elasticity ranging from about 145 psi to about 14500 psi.

9. The covered roll structure according to claim 1, wherein the ratio of the thickness of said sleeve of removable material to the circumference of said core roll ranges from about 0.02 to about 1.

10. The covered roll structure according to claim 1, wherein the ratio of the thickness of said sleeve of compressible material to the circumference of said core roll ranges from about 0.02 to about 1.

11. The covered roll structure according to claim 1, wherein said core roll has a coefficient of thermal expansion ranging from about $5\times10^6$ to about $20\times10^{-6}$ in/in ° C.

12. A covered roll structure employed in the manufacture of a paper machine roll, said roll structure comprising:

a core roll having a substantially cylindrical outer surface;

a sleeve of removable material surrounding said core roll outer surface;

a sleeve of compressible material surrounding said sleeve of removable material, wherein said compressible material has a modulus of elasticity ranging from about 145 psi to about 14,500 psi; and a sleeve of polymeric material surrounding said sleeve of removable material and said sleeve of compressible material.

13. The roll according to claim 12, wherein said polymeric material has a modulus of elasticity ranging from about $20\times10^4$ psi to about $30\times10^6$ psi.

14. The roll according to claim 12, wherein the compressible material is selected from the group consisting of polyester, polyamide, para-amide, polyurethane and butadiene.

15. The roll according to claim 12, wherein the polymeric material is selected from the group consisting of polypropylene, polyethersulfone, polyetheretherketone, epoxy, polyimide and polyurethane.

16. The roll according to claim 12, wherein the ratio of the thickness of said sleeve of compressible material to the circumference of said core roll ranges from about 0.02 to about 1.

* * * * *